US006364462B1

(12) United States Patent
Furukawa et al.

(10) Patent No.: US 6,364,462 B1
(45) Date of Patent: Apr. 2, 2002

(54) IMAGE RECORDING METHOD AND IMAGE RECORDING APPARATUS PERMITTING GOOD PICTURE QUALITY TO BE PROVIDED

(75) Inventors: Kazuhiko Furukawa, Tenri; Tohru Okuda; Shigeaki Kakiwaki, both of Nara, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/248,937

(22) Filed: Feb. 12, 1999

(30) Foreign Application Priority Data

Feb. 13, 1998 (JP) ..... 10-031232

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158, 68, 69, 70, 71, 72; 399/261, 290, 291, 292, 293, 294, 295, 271

(56) References Cited

U.S. PATENT DOCUMENTS 3,434,865 A * 3/1969 Doquire et al. ..... 347/89
3,719,952 A * 3/1973 Elbaum ..... 347/89
3,983,801 A * 10/1976 Watanabe et al. ..... 347/89
4,013,004 A * 3/1977 Watanabe et al. ..... 347/89
4,024,811 A * 5/1977 Watanabe et al. ..... 347/89
4,117,778 A * 10/1978 Watanabe et al. ..... 347/89

FOREIGN PATENT DOCUMENTS

EP 0 791 457 A2 * 8/1997
JP 8-300803 11/1996

* cited by examiner

*Primary Examiner*—Raquel Yvette Gordon
(74) *Attorney, Agent, or Firm*—Dike, Bronstein, Roberts & Cushman, IP Group; David G. Conlin; Geroge W. Hartnell, III

(57) ABSTRACT

An image recording apparatus includes a heating portion and a granulating portion to generate colorant particles, a charging portion to charge the generated colorant particles, an ejecting portion to intermittently eject the charged colorant particles onto a recording medium in response to an electrical signal corresponding to image data to be recorded, and a transport portion to sequentially transport the colorant particles through these portions. The heating portion heats and evaporates solid or liquid colorant. The evaporated colorant is transported to the granulating portion, cooled, solidified and agglomerated into colorant particles. The colorant particles are transported to the succeeding charging portion, charged there and transported to the ejecting portion. The charged colorant particles are electrically induced toward a recording medium through an ejection hole and ejected onto a recording medium, so that the colorant particles stick and permeates to the medium according to image data.

15 Claims, 5 Drawing Sheets

IMAGE RECORDING METHOD AND IMAGE RECORDING APPARATUS PERMITTING GOOD PICTURE QUALITY TO BE PROVIDED

BACKGROUND OF THE INVENTION

1. Field of the Invention

The present invention relates generally to methods for recording images and apparatuses for recording images such as copying machine, facsimile and printer, and more particularly, to a method and an apparatus for recording images by intermittently allowing colorant particles to be ejected on a recording medium, thereby selectively applying on or permeating the particles into the medium to form images thereon.

2. Description of the Background Art

A conventional image recording apparatus has been proposed, by which colorant is evaporated, then ionized, and ejected intermittently based on an electrical signal corresponding to image data to be recorded, whereby the colorant is applied on or permeated into a recording medium to provide images. Such an image recording apparatus is for example disclosed by Japanese Patent Laying-Open No. 8-300803. The image recording apparatus will be now described.

FIG. 8 is a view for use in illustration of an example of a conventional image recording apparatus. In FIG. 8, the image recording apparatus includes a printing head 1. Printing head 1 is formed by integrating a heating device 10 to heat and evaporate colorant, a charging device 30 to charge the evaporated colorant, and an ejecting device 50 to intermittently eject the charged colorant based on an electrical signal corresponding to image data to be recorded.

Heating device 10 includes an electrical heater 10B. Charging device 30 includes an ionization electrode portion 30A having a needle shape for example, and a counter electrode portion 30B having a plate shape. In ejecting device 50, a back plate electrode portion 50C is provided at the back of a recording medium RM in order that the charged colorant through an ejecting outlet 90 onto recording medium RM for ejection with electrostatic force, an intermediate electrode portion 50A (50A1, 50A2, 50A3) is provided around ejecting outlet 90, and an intermediate electrode driving control portion 50E is also provided. Intermediate electrode portion 50A (50A1, 50A2, 50A3) has a so-called shutter function to physically or electrically control the ejection of the colorant. Intermediate electrode driving portion 50E outputs a driving signal corresponding to an input electrical signal corresponding to image data and controls intermediate electrode portion 50A (50A1, 50A2, 50A3) in a shutter manner. An insulating plate 50D is provided around intermediate electrode portion 50A (50A1, 50A2, 50A3).

In printing head 1, powder ink IP is previously stored. Heating device 10 to heat ink IP is provided at the lower half of printing head 1. At the upper half of printing head 1, a wire electrode from 50 $\mu$m to 80 $\mu$m is provided as charging device 30 to charge heated and evaporated ink IPG. At the upper part of printing head 1, an ejecting outlet 90 of $\phi$300 $\mu$m to allow evaporated ink IPG to be ejected therethrough is provided, and intermediate electrode portion 50A (50A1, 50A2, 50A3) having an inner diameter of $\phi$300 $\mu$m is provided to surround ejecting outlet 90.

The operations of the image recording apparatus shown in FIG. 8 will be now described. During printing, ink IP is heated to 200°C. and evaporated. When colored inks are used, the colorant may include as a base, anthoraisothiazole, quinophthalone, pyazolonazo, pyiidone azo, styryl or the like for yellow, anthraquinone, dicyanoimidazole, thiadiazoleazo, tricyanovinyl, or the like for magenta, and azo, anthraquinone, naphthoquinone, indoaniline, or the like for cyan. Evaporated ink IPG is ionized by applying a voltage at +5 kV to charging device 30. Ionized evaporated ink IPG is controlled to be ejected on recording medium RM in response to application of a prescribed voltage to back plate electrode portion 50C and intermediate electrode portion 50A (50A1, 50A2, 50A3).

The image recording apparatus shown in FIG. 8 however suffers from the following disadvantage. When ink is ionized by a strong electric field in the vicinity of ionization electrode portion 30A, the ionization efficiency is low, i.e., the efficiency of transporting of evaporated ink IPG into a possible ionization area and the efficiency of ionization of evaporated ink IPG thus transported in total are low, therefore the ratio of effective evaporated ink which can be controlled for ejection is small, and the recording speed is low. If an electric field to ionize evaporated ink IPG is generated, air in the vicinity of ionization electrode portion 30A is also ionized. Therefore, the ions act as a driving force to cause a flow of ionized air, evaporated ink IPG present in the area where the ionized air flows is brought by the flow and sticks to counter electrode portion 30B. As a result, the percentage of evaporated ink IPG which can be used for recording is low.

SUMMARY OF THE INVENTION

It is an object of the present invention to provide a method and an apparatus for recording images, which allows for increase in the charging efficiency of colorant particles, the charge amount, the use efficiency and the recording speed and permits good picture qualities to be provided.

In order to achieve this object, an image recording method according to the present invention includes the following characteristics. More specifically, the method includes the steps of generating colorant particles from ink colorant, charging the generated colorant particles, and intermittently ejecting the charged colorant particles onto a recording medium by electrostatic force based on an electrical signal corresponding to prescribed image data.

The colorant particles are transported sequentially from the generating step to the charging step and to the ejecting step.

The generating step may further include the steps of heating and evaporating ink colorant, cooling, solidifying and agglomerating the evaporated ink colorant, thereby granulating the colorant into colorant particles.

In the image recording method as described above, the colorant particles generated in the generating step are transported sequentially from the generating step to the charging step and the ejection step, and therefore the colorant particles may securely gone through each step, so that the use efficiency of the colorant in image recording may be improved and the charge amount may become even.

Since the colorant particles are transported while controlling the flow of air including the colorant particles in the above image recording method, the colorant particles generated in the generating step are transported surely to the following steps in the flow of air. The airflow is controlled, and therefore the colorant particles will not be attached in an undesired location in the flow path or the amount of ejection in the ejection step will not be uneven. Thus, the colorant particle density may be improved to increase the recording speed as a result.

In order to achieve the above-described object of the present invention, an image recording apparatus according to the present invention records prescribed images on a recording medium using ink colorant has the following characteristics. More specifically, the apparatus includes a generating portion which generates colorant particles from ink colorant, a charging portion which charges the generated colorant particles, an ejecting portion which intermittently ejects the charged colorant particles onto the recording medium by electrostatic force based on an electrical signal corresponding to prescribed image data, and a transport portion which sequentially transports the colorant particles from the generating portion to the charging portion and the ejecting portion.

Therefore, the generated colorant particles are surely passed through each portion, the use efficiency of the colorant is improved and the charge amount may become even.

In the above image recording apparatus, the generating portion may include a heating portion for heating and evaporating colorant, and a granulating portion for cooling, solidifying and agglomerating the colorant evaporated by the heating portion, thereby granulating the colorant into colorant particles.

The granulating portion may include a particle size control portion which controls the particle size in granulating the ink colorant evaporated by the heating portion.

Therefore, the particle size of the ink colorant is controlled at a size suitable for recording by the particle size control portion, and good quality images result.

The transport portion as described above may include an airflow generating portion to generate an airflow for sequentially transporting the colorant particles from the generating portion to the charging portion and the ejecting portion, and a flow control portion to control the generated airflow.

Therefore, generated colorant particles are surely transported to each portion by the transport portion. Furthermore, the flow control portion may control the airflow, which prevents the colorant particles from being attached in an undesired location in the flow path, and the ejection amount from becoming uneven, so that the recording speed may be improved.

The charging portion as described above has its lengthwise direction corresponding to the transport direction of the colorant particles, and may include corona discharge means which is arranged in axial symmetry in a cross sectional direction corresponding to the transport direction.

Thus, the air ions generated by corona discharge at the charging portion may move along the line of electric force and impinge the colorant particles being transported to charge the colorant particles, and therefore almost the entire colorant may be charged, so that the charging efficiency may be improved. As a result, the ejection speed and the recording speed increase, and good quality recorded images may be stably provided.

A flow of ionized air is generated at the charging portion by corona discharge, but the colorant particles are transported in an airflow by the transport portion, and therefore the amount of colorant particles drawn to the ionized airflow at the charging portion attached to an undesired part of the charging portion may be reduced.

Since at the charging portion the ionized air impinges upon all the colorant particles transported by corona discharge, few uncharged particles are generated, and variations in the charge amount may be restrained as well. Furthermore, the lengthwise direction of the charging portion corresponds to the transport direction of colorant particles, and therefore a long time period may be secured for charging the colorant particles, which may increase the charge amount.

In the image recording apparatus as described above, a circulating flow path structure to sequentially circulate the colorant particles through the generating portion, charging portion and ejecting portion may be employed.

Thus, the colorant particles circulate each portion in the image recording apparatus, and colorant particles not used for recording may be recycled. These unused colorant particles are once again transported to the charging portion, has its charge amount increased and is then used for recording, which improves the use efficiency of the colorant particles. In addition, since the charge amount for colorant particles increases, the ejection speed increases, and an increased recording speed results.

The above-described generating portion may be an ultrasonic vibrating portion which vibrates ink colorant by an ultrasonic to generate colorant particles.

The above-described transport portion may include a speed control portion to limit the transport speed of colorant particles. Thus, the transport speed of colorant particles may be controlled such that images may be appropriately recorded.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Image recording methods and apparatuses according to first to fifth embodiments of the present invention will be now described in conjunction with the accompanying drawings.

First Embodiment

Figure 1:
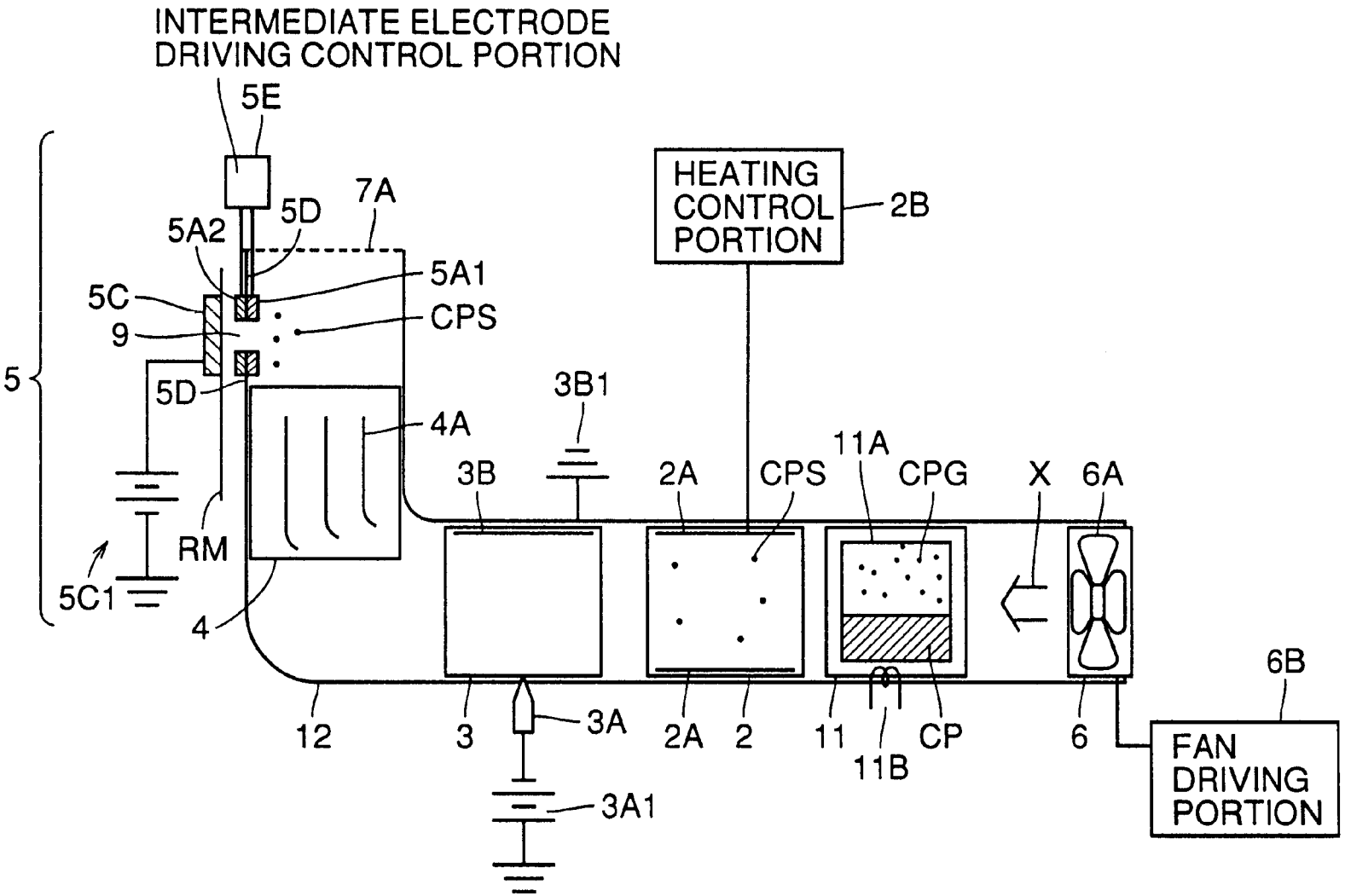
FIG. 1 is a view for use in illustration of an image recording apparatus according to a first embodiment of the present invention.

An image recording apparatus according to a first embodiment of the invention shown in FIG. 1 has a tubular chamber 12 to heat and evaporate solid ink, charge the evaporated ink particles for electrostatic control, and form images on a recording surface of a recording medium RM. There are provided in chamber 12, sequentially from one end to the other end, a transport device 6 to transport gaseous ink particles in chamber 12, a heating device 11 to heat and evaporate the solid ink, a granulating device 2 to form evaporated ink into prescribed particles, a charging device 3 to charge the evaporated ink particles, a flow control device 4 to control an airflow including the charged ink particles, an ejecting device 5 to allow the charged ink particles to be ejected onto a recording surface of recording medium RM, and a filter 7A to let out the airflow from chamber 12 while preventing the ink particles from being passed therethrough.

Transport device 6 is provided at one end of chamber 12 and has a DC micro-fan 6A and a fan driving portion 6B which controls driving of DC micro-fan 6A. DC micro-fan 6A is driven by fan driving portion 6B to generate an airflow including evaporated ink particles from the one end side to the other end side in chamber 12. Heating device 11 includes an ink pot 11A to pre-store powder colorant CP and an electric heater 11B provided under ink pot 11A to heat and evaporate power colorant CP. Next to heating device 11 in chamber 12, there is provided a granulating device 2 which agglomerates evaporated colorant CPG obtained by heating powder colorant CP by heating device 11 and granulates the colorant into a suitable size for image forming to generate colorant particles CPS. In order to generate colorant particles CPS, provided at the wall of the flow path of evaporated colorant CP in granulating device 2 is a flat heating element 2A such as a heat-resisting resin film with a little conductivity which generates heat by Joule heat under the control of heating control portion 2B. Next to granulating device 2 in chamber 12, a charging device 3 to charge colorant particles CPS is provided. Charging device 3 includes for example an electrode 3A and an electrode 3B used for forming an electric field for corona discharge in order to generate ions. Electrodes 3A and 3B provided opposite to each other with the flow path of colorant particles CPS therebetween, and application of potentials is controlled by corresponding potential control portions 3A1 and 3B1. Next to charging device 3 in chamber 12, a flow control device 4 is provided. Flow control device 4 has for example a plurality of flow control plates 4A arranged parallel to each other in the flow path containing colorant particles CPS. Next to flow control device 4 in chamber 12, an ejecting device 5 is provided. Ejecting device 5 is provided with an ejecting outlet 9 of $\phi 300\ \mu m$ opposite to the recording surface of recording medium RM for ejecting colorant particles CPS toward the recording surface, and there are intermediate electrode portions 5A (5A1, 5A2) of inner diameter of $\phi 300\ \mu m$ surrounding ejecting outlet 9 at both surfaces of an insulating plate 5D. A back plate electrode 5C is provided at a gap from insulating plate 5D so that colorant particles CPS may be transported toward the recording surface of recording medium RM from the inside of chamber 12. Back plate electrode 5C is provided at a surface opposite to the recording surface of recording medium RM, and potentials applied to the electrode are controlled by a potential control portion 5C1. Next to ejecting device 5 in chamber 12, a filter 7A is provided. Filter 7A is provided to recover unused colorant particles CPS. The operations of the image recording apparatus as shown in FIG. 1 will be now described.

In a stand-by state, DC micro-fan 6A is started to generate an airflow in the direction denoted by the arrow X in chamber 12. At the time of printing, powder colorant CP is heated to 200° C. and evaporated by heating device 11. When colored ink is used as colorant, the colorant may include as a base, anthoraisothiazole, quinophthalone, pyazolonazo, pyridone azo, styryl or the like for yellow, anthraquinone, dicyanoimidazole, thiadiazoleazo, tricyanovinyl, or the like for magenta, and azo, anthraquinone, naphthoquinone, indoaniline, or the like for cyan.

When colorant CP is evaporated and transported to granulating device 2, the colorant is cooled, solidified, and agglomerated into colorant particles CPS. When evaporated colorant CP spontaneously cools without heat generated by heating element 2A, colorant particles CPS having an average particle size of 0.8 $\mu m$ are generated. Meanwhile, if evaporated colorant CP is gradually cooled as granulating device 2 is heated by heating element 2A, the heat generated by heating element 2A may be controlled by heating control portion 2B to control the particle size of colorant particles CPS. Then, colorant particles CPS are transported to charging device 3. Electrode 3A has a sharp tip end directed to the flow path of colorant particles CPS, and electrode 3B has a plate shape. Herein, electrode 3A may be a needle electrode or may have a sharp tip end extending for the size of the cross section in the vertical direction to the flow path direction of colorant particles CPS or may be in other forms.

Electrode 3B may be a plate shaped electrode expanded fully over the upper wall in charging device 3 in chamber 12. Thus, a potential difference in such a level to cause air to be ionized around electrode 3A is provided between the two electrodes by potential control portions 3A1 and 3B1, so that the ions move toward electrode 3B according to the electric force line generated between the electrodes. At this time, the ions impinge upon and are attached to colorant particles CPS being transported, and colorant particles CPS are charged as a result. More specifically, if −5 kV is applied to electrode 3A and 0 V to electrode 3B by potential control portions 3A1 and 3B1,—ions move from electrode 3A to electrode 3B, and therefore colorant particles CPS are negatively charged. The airflow containing charged colorant particles CPS is controlled by control plates 4A in flow control device 4 and transported to ejecting device 5 such that colorant particles CPS are supplied evenly on the recording surface of recording medium RM. Ejecting device 5 is provided with a prescribed voltage at intermediate electrode portion 5A (5A1, 5A2) and at back plate electrode portion 5C, and charged colorant particles CPS are ejected onto the recording surface of recording medium RM through ejecting outlet 9. More specifically, a voltage of 0V or −500 V is applied to intermediate electrode portion 5A (5A1, 5A2) by an output signal from an intermediate electrode driving control portion 5E corresponding to an electrical signal for image data to be recorded, while back plate electrode portion 5C is provided with a voltage in the range from +1.0 kV to +2 kV by potential control portion 5C1. Herein, an electric field formed at ejecting outlet 9 controls colorant particles CPS to be ejected by electrostatic force. For example, if OV is applied to both intermediate electrode portions 5A1 and 5A2, charged colorant particles CPS are ejected through ejecting outlet 90, and an image is printed on the recording surface of recording medium RM.

According to this embodiment, heating device 11, granulating device 2, charging device 3, and ejecting device 5 to generate (by heating and granulating colorant), charge and eject colorant particles CPS are sequentially provided, and transport device 6 to sequentially transport colorant particles CPS to these devices is provided so that generated colorant particles CPS surely pass through each device, and the use efficiency improves and the charge amount becomes even. Particularly in charging device 3, colorant particles CPS are transported in an airflow and therefore may be restrained from being drawn to and from being attached to electrode 3B. The colorant becomes solid particles by providing granulating device 2, and therefore ionized air generated by charging device 3 may move according to the electric force line to impinge upon and charge colorant particles CPS. Therefore, almost the entire evaporated colorant CPG may be charged, in other words, the charging efficiency significantly improves. In general, the contact charging method which allows charged particles and particles to be changed to contact is often employed for advantages in the time constant and the charge amount. If the contact charging method is employed in this embodiment, colorant particles CPS to be charged in the order of 1 $\mu$m and contacting charged members can hardly be separated. Therefore, this embodiment employs the method of charging colorant particles by allowing ions to be attached to colorant particles CPS as described above, so that the charged colorant particles CPS may be readily effectively utilized.

Figure 2:
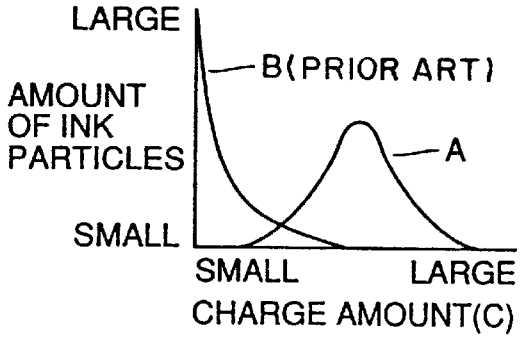
FIG. 2 is a graph showing the distribution of the charge amount of colorant particles according to the present invention and a conventional method.
Figure 8:
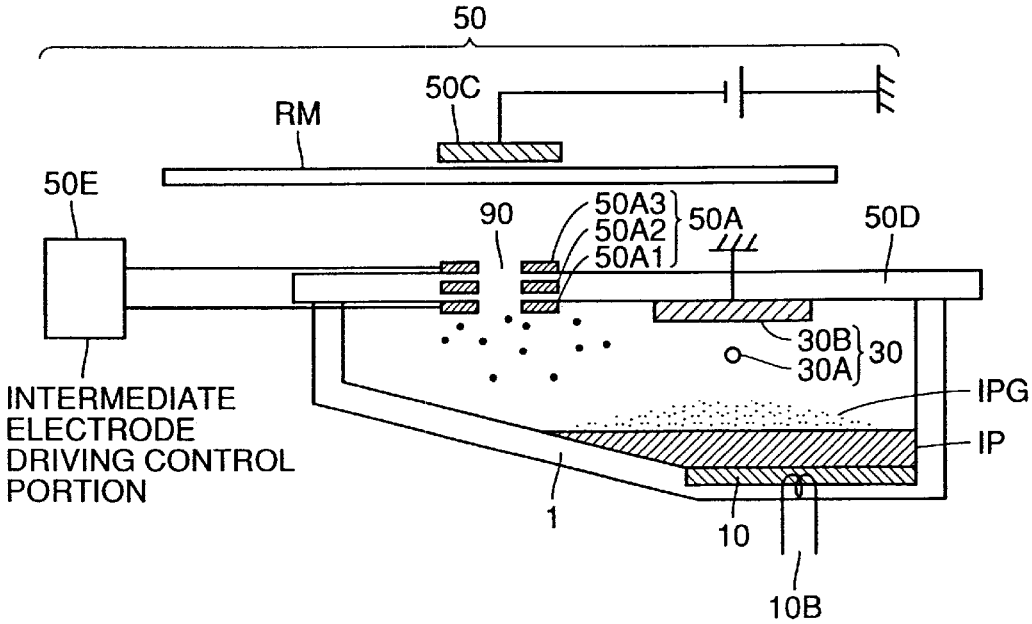
FIG.8 PRIOR ART
FIG. 8 is a view for use in illustration of a conventional image recording apparatus.

The result of measurement of the charging efficiency for colorant particles CPS according to this embodiment is given in FIG. 2. FIG. 2 shows the charge amount distribution of ink particles which passed the charging area. The ordinate represents the mass amount of ink particles, the abscissa the charge amount of an ink particle. The measurement result of the charging efficiency of colorant particles in the conventional image recording apparatus in FIG. 8 is shown in solid line B, and the measurement result of the charging efficiency of colorant particles according to the embodiment shown in FIG. 1 is shown in solid line A. As shown in FIG. 2, in the measurement result of the charging efficiency of colorant particles CPS in the conventional image recording apparatus, a lot of uncharged colorant particles exist, while in the image recording apparatus according to this embodiment shown in FIG. 1, as shown in solid line A, there is almost no entirely uncharged colorant particles though the charge amount varies among colorant particles CPS.

Figure 3A:
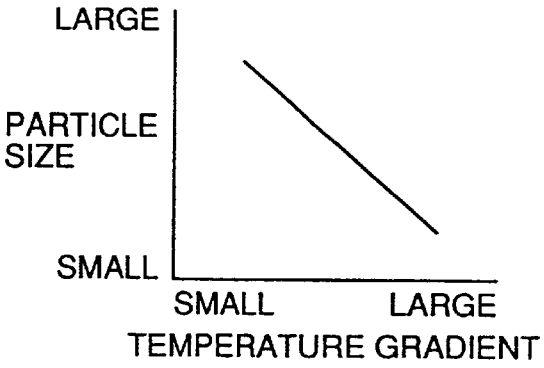
FIGS. 3A and 3B are graphs showing the relation between the granulating condition and particle size in the image recording apparatus shown in FIG. 1.
Figure 3B:
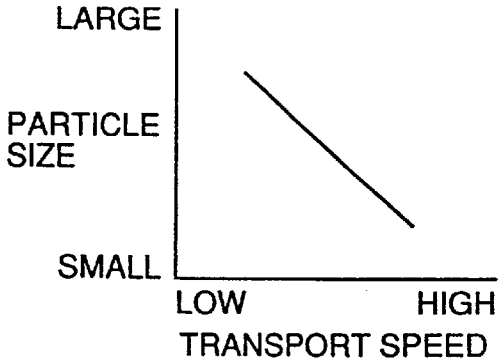

Furthermore, by controlling the temperature gradient related to heating by heating element 2A in granulating device 2 and the transport speed of colorant particles CPS, the particle size of colorant particles CPS may be controlled as desired as shown in FIGS. 3A and 3B. FIG. 3A shows the relation between the particle size of colorant particles CPS and the temperature gradient related to heating by heating element 2A, and FIG. 3B shows the relation between the particle size of colorant particles CPS and the transport speed. The particle size may be increased for example by gradually cooling colorant particles CPS in granulating device 2 by controlling heat generated by heating element 2A with heating control portion 2B. Using fan driving portion 6B as shown in FIG. 3B, the transport speed of colorant particles CPS by DC micro-fan 6A in granulating device 2 may be lowered to increase the particle size.

According to this embodiment, colorant particles CPS are transported directly by air and indirectly by DC micro-fan 6A. In general, the weight of micro-particles having a particle size of 1 $\mu$m may be ignored in a mobile medium, and therefore the use of airflow as in this embodiment is preferable for the transport of colorant particles CPS as compared to the method using a belt or roller where a complex structure is required and colorant particles CPS are undesirably deposited. In this embodiment, the air over the heating surface by electric heater 11B in heating device 11 flows and is exchanged so that the saturated vapor immediately above the evaporation surface of colorant particles CP by electric heater 11B is lowered, and the amount of evaporated powder colorant CP is effectively increased as well. Meanwhile, if the airflow in chamber 12 is greatly disturbed, colorant p articles CPS could be attached in an undesired location in the flow path, or the ejection amount could vary. However, according to this embodiment, since the airflow containing colorant particles CPS is controlled by the plurality of control plates 4A, such disadvantage could be significantly alleviated. The airflow controlling method treats the speed as a parameter, and therefore the airflow containing colorant particles CPS may be formed into a turbulent flow or stream line flow. Based on the measurement, the stream line flow significantly reduced the sticking of colorant particles CPS in an undesired location in chamber 12, and the density of colorant particles CPS was increased in the vicinity of ejecting outlet 9 by placing colorant particles CPS in the stream line of the airflow generated in the vicinity of ejecting outlet 9. As a result, the recording density related to image recording on the recording surface of recording medium RM was improved. For example, in a device having a flow path cross section as large as 20×20 mm, and a total length of 200 mm, a stream line was provided at an airflow rate of 0.35 m/s. Therefore, when Reynolds number Re =v·d /v(v: flow rate, d: flow path size, v. air kinematic viscosity), the flow path and flow rate need only be set to satisfy Re <500. Since the flow rate acts upon the condition setting with great sensitivity, the use of fan driving portion 6B for fine tuning related to DC micro-fan GA permits these controls to be readily made.

Second Embodiment

A charging device according to a second embodiment applied to the image recording apparatus according to the present invention will be now described.

Figure 4A:
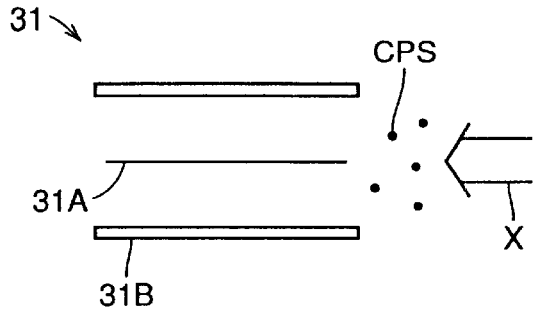
FIGS. 4A and 4B are views for use in illustration of a charging device applied in an image recording apparatus according to a second embodiment of the present invention.
Figure 4B:
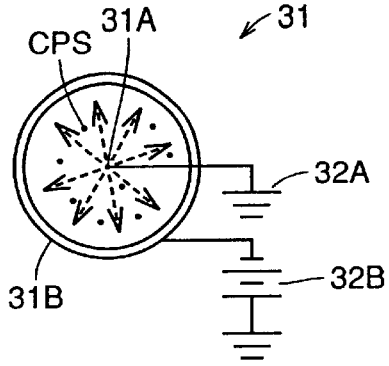

FIGS. 4A and 4B are diagrams showing essential part of a charging device 31. FIG. 4A is a side view of the essential part of charging device 31, while FIG. 4B is a front view of the essential part. The arrow in broken line in FIG. 4B indicates the direction of transporting ions of air generated in neighborhood of electrode 31A and the direction X denoted by the arrow in FIG. 4A indicates the direction of transporting colorant particles CPS by the airflow. The lengthwise direction of charging device 31 matches the direction of airflow X, and the cross-sectional direction to the airflow direction X is in axial symmetry. An electrode 31A is a tungsten wire having a diameter of several ten $\mu$m, and an electrode 31B is an aluminum tube having an outer diameter of 20 mm, and a thickness of 1mm. When 0V and −5 kV are applied to electrodes 31A and 31B, respectively through potential control portions 32A and 32B, for example, positive ions generated around electrode 31A move toward electrode 31B. As shown in FIG. 4B, the cross-sectional direction of the airflow is in axial symmetry in charging device 31, and therefore, the ions move in every direction at the cross section. Thus, all the colorant particles CPS transported into charging device 31 impinge ions of air and are charged, in other words, there will be no uncharged colorant particles, and variations in the charge amount for colorant particles CPS are reduced. Furthermore, since the airflow direction X matches the lengthwise direction of charging device 31, the effect of charging colorant particles CPS may last long, which may increase the charge amount for colorant particles CPS. The charge amount for colorant particles CPS may be also controlled by adjusting the size of charging device 31 in the lengthwise direction.

Note that colorant particles CPS may be transported using transport device 6 as shown in FIG. 1.

Third Embodiment

Figure 5:
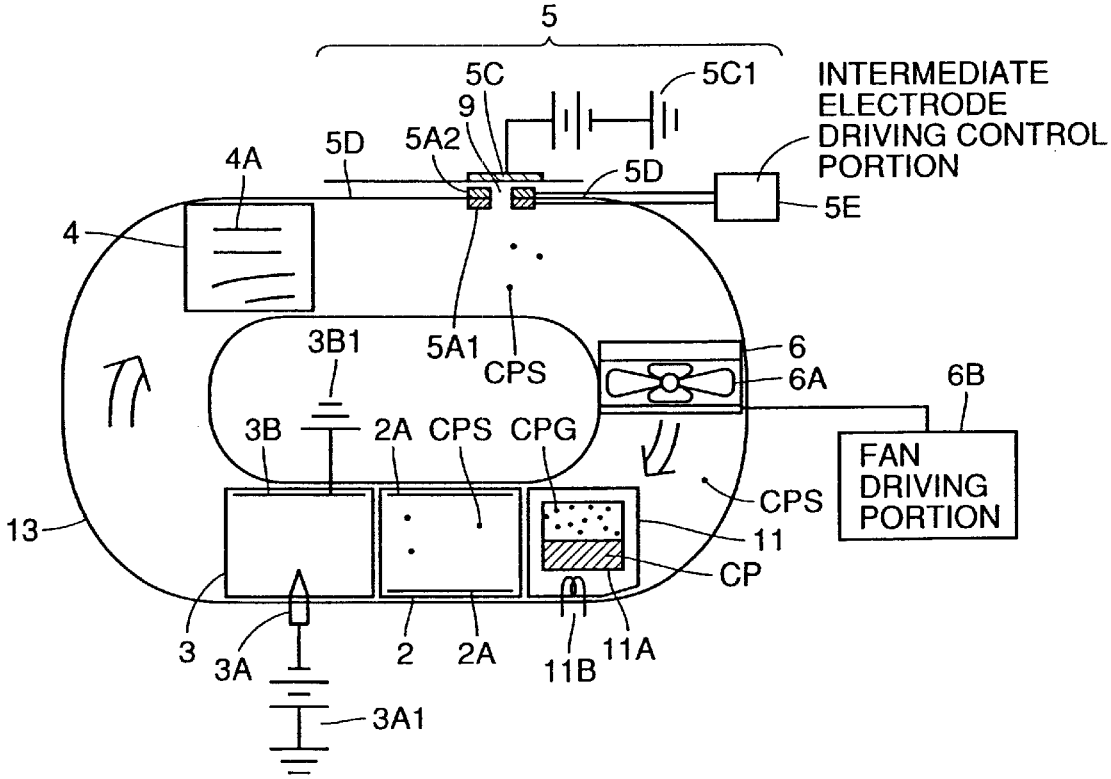
FIG. 5 is a view for use in illustration of an image recording apparatus according to a third embodiment of the present invention.

An image recording apparatus according to a third embodiment of the present invention will be now described. FIG. 5 shows the structure of this image recording apparatus according to the third embodiment. In FIG. 5, the portions denoted by the same reference characters as those in FIG. 1 have the same structure and operate in the same manner as those in the image recording apparatus according to the first embodiment, and will not be described. Portions different from those in FIG. 1 will be described. FIG. 5 is different from FIG. 1 in that in a closed annular chamber 13, an airflow including colorant particles CPS sequentially passed through a generation device for colorant particles CPS (a heating device 11 and a granulating device 2), a charging device 3, a flow control device 4, and an ejecting device 5 is once again circulated through these devices. Since chamber 13 is apparently highly tightly sealed, the airflow circulates within chamber 13 at a flow rate with a small variation. By allowing colorant particles CPS to circulate through the devices, colorant particles CPS not used for recording will be re-used. Furthermore, the colorant particles CPS not used for recording are highly likely to have a small charge amount, and therefore, may be transported to charging device 3 once again through transport device 6, heating device 11 and granulating device 2, so that the charge amount increases in charging device 3. These colorant particles CPS having their charge amounts increased will be later used for recording through flow control device 4 and ejecting device 5, which improves the use efficiency for colorant particles CPS. Since the charge amount for colorant particles CPS increases, the speed at which colorant particles CPS are ejected from ejecting outlet 9 increases, which results in improvement in the recording speed.

Corona discharge is employed for generating ions in charging devices 3 and 31 described above, but the photoelectric conversion effect or the like may be used as well. Ink in a powder state at room temperatures is used as colorant CP to be heated in heating device 11, but ink in a liquid state at room temperatures may be used. In this case, the time and energy required for evaporating colorant CP in heating device 11 are advantageously reduced.

Forth Embodiment

An ultrasonic vibrating device may be provided in place of heating device 11 and granulating device 2 such that liquid ink may be formed into fine ink particles and colorant particles CPS may be provided.

Figure 6:
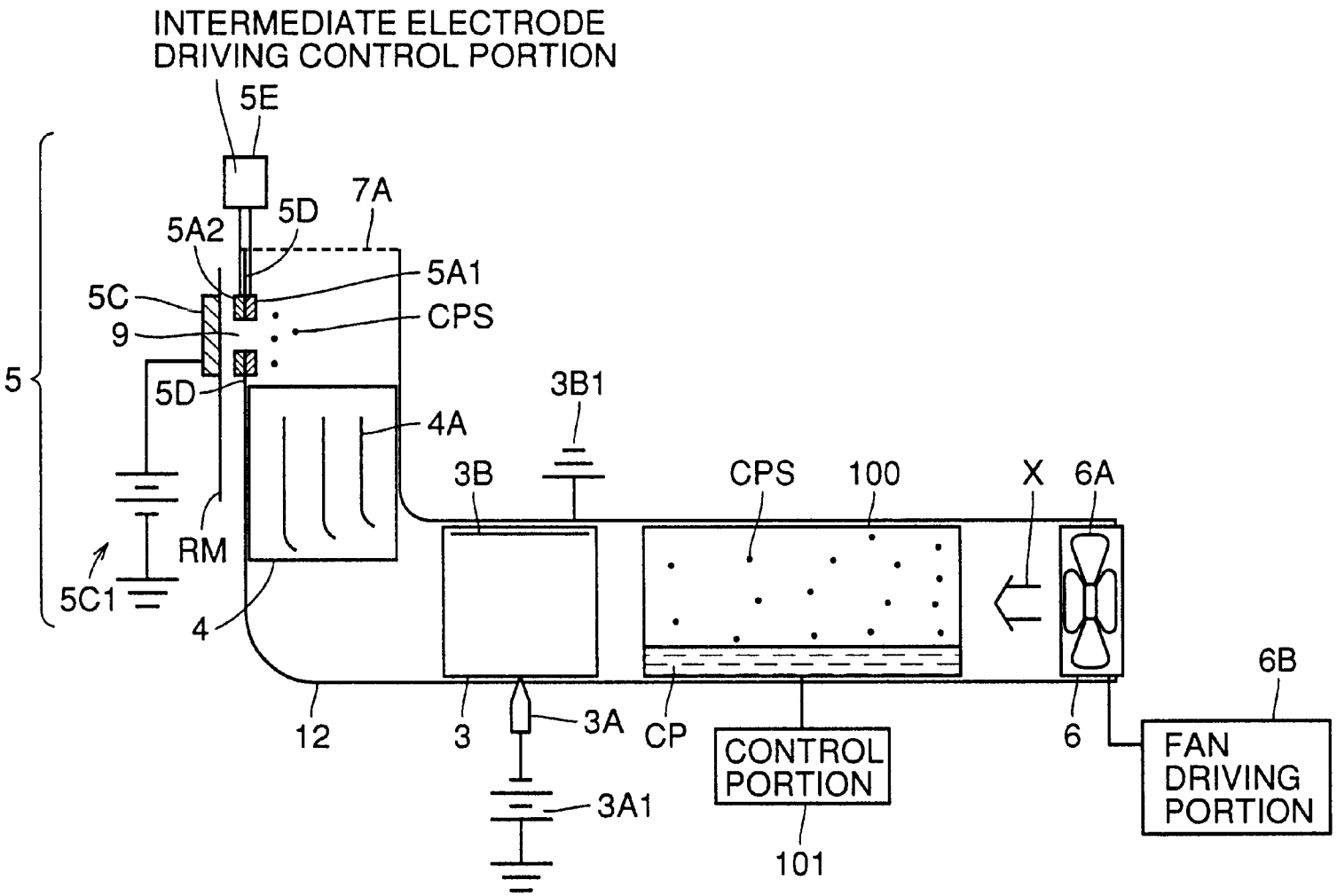
FIG. 6 is a view for use in illustration of an image recording apparatus according to a fourth embodiment of the present invention.

FIG. 6 is a diagram of an image recording apparatus provided with such an ultrasonic vibrating device. In FIG. 6, ultrasonic vibrating device 100 is provided in place of heating device 11 and granulating device 2 in FIG. 1. Ultrasonic vibrating device 100 has a portion to previously store liquid colorant CP and a control device 101 to output an ultrasonic to stored colorant CP. In operation, colorant CP is vibrated by an ultrasonic output from control device 101 and formed into fine colorant particles CPS. Colorant particles CPS thus generated are sequentially transported to the respective portions, as is the case with FIG. 1.

Fifth Embodiment

Figure 7:
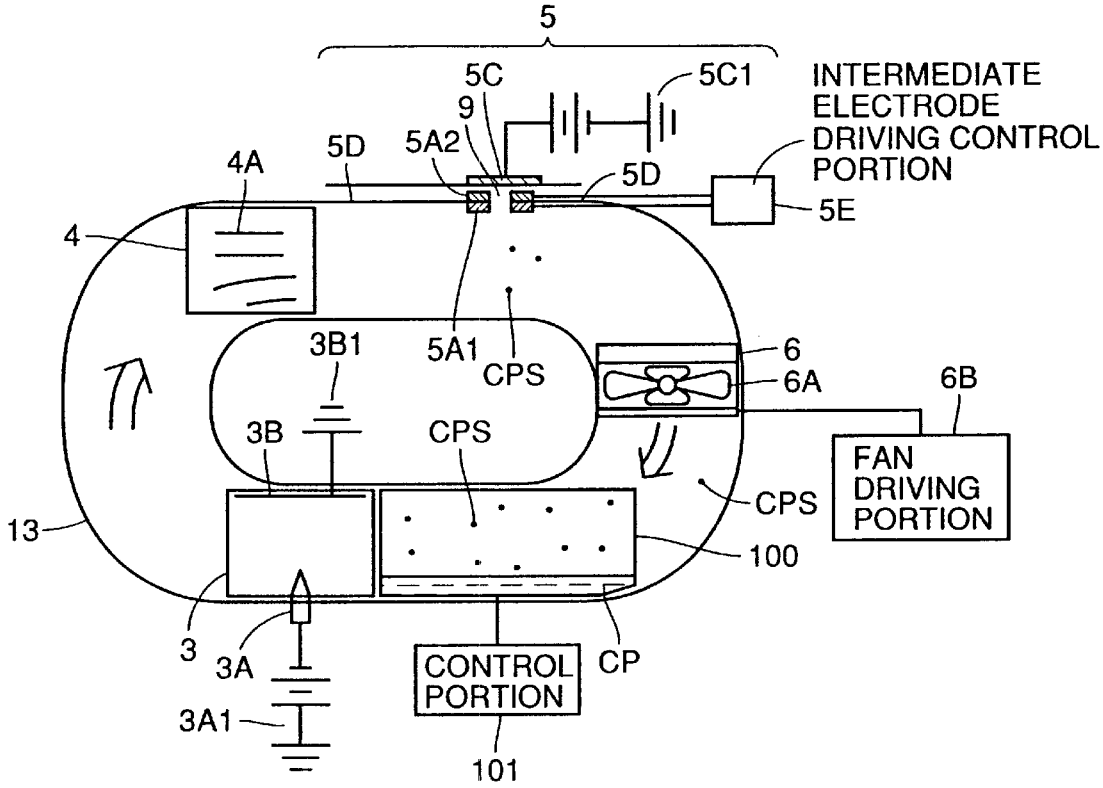
FIG. 7 is a view for use in illustration of an image recording apparatus according to a fifth embodiment of the present invention.

In FIG. 7, an ultrasonic vibrating device 100 is provided in place of heating device 11 and granulating device 2 in FIG. 5. Ultrasonic vibrating device 100 has a portion to previously store liquid colorant CP and a control device 101 to output an ultrasonic to colorant CP. In operation, colorant CP is vibrated by an ultrasonic output from control device 101 and formed into fine colorant particles CPS. Colorant particles CPS thus generated are sequentially transported to the respective portions, as is the case with FIG. 5.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A method of recording a prescribed image on a recording medium using ink colorant, comprising the steps of:

generating colorant particles from said ink colorant;

charging said colorant particles generated in said generating step; and intermittently ejecting said colorant particles charged in said charging step onto said recording medium by electrostatic force in response to an electrical signal corresponding to data of said prescribed image, said colorant particles being sequentially transported from said generating step to said charging step and then to said ejecting step by controlling an airflow including said colorant particles, wherein said airflow has a direction.

2. The method as recited in claim 1, wherein said generating step includes the steps of:

heating and evaporating said ink colorant; and granulating said colorant particles by cooling, solidifying and agglomerating said ink colorant evaporated in said evaporating step.

3. The method as recited in claim 1, wherein in the step of charging the colorant particles, the colorant particles are charged by unipolar charges that adhere to the colorant particles.

4. The method as recited in claim 3, wherein the direction of airflow transporting the colorant particles is approximately orthogonal to the direction of movement of the unipolar charges.

5. An image recording apparatus for recording a prescribed image on a recording medium using ink colorant, comprising:

means for generating colorant particles from said ink colorant;

means for charging said colorant particles generated by said generating means;

means for intermittently ejecting said colorant particles charged by said charging means on a recording medium by electrostatic force in response to an electrical signal corresponding to data of said prescribed image; and means for sequertially transporting said colorant particles from said generating means to said charging means and then to said ejecting means by controlling an airflow, including said colorant particles, wherein said airflow has a direction.

6. The apparatus as recited in claim 5, wherein said generating means includes:

means for heating and evaporating said ink colorant; and granulating means for cooling, solidifying and agglomerating said ink colorant evaporated by said heating means into said colorant particles.

7. The apparatus as recited in claim 6, wherein said granulating means includes particle size control means for controlling the particle size in granulating said ink colorant evaporated by said heating means.

8. The apparatus as recited in claim 5, wherein said transport means includes:

airflow generating means for generating an airflow to sequentially transport said colorant particles from said generating means to said charging means and said ejecting means; and flow control means for controlling the airflow generated by said airflow generating means.

9. The apparatus as recited in claim 8, wherein the airflow generating means generates an airflow such that the airflow is adjusted by the flow control means to be a laminar flow.

10. The apparatus as recited in claim 5, wherein said charging means has its lengthwise direction corresponding to the direction of transporting said colorant particles and includes corona discharge means having its cross-sectional direction to said transporting direction arranged in axial symmetry for corona-discharging, and ions of air generated by corona discharge by said corona discharge means and moving in said cross-sectional direction are attached to said colorant particles transported in said lengthwise direction such that said colorant particles are charged.

11. The apparatus as recited in claim 5, further comprising a circulating flow path for said colorant particles to sequentially circulate from said generating means to said charging means and said ejecting means.

12. The apparatus as recited in claim 5, wherein said generating means is ultrasonic vibrating means for vibrating said ink colorant by an ultrasonic, thereby forming said ink colorant into said colorant particles.

13. The apparatus as recited in claim 5, wherein said transport means includes speed control means for controlling the speed of transporting said colorant particles.

14. The apparatus as recited in claim 5, wherein the charging means includes a means for generating unipolar charges to charge the colorant particles.

15. The apparatus as recited in claim 14, wherein the direction of airflow transporting the colorant particles is approximately orthogonal to the direction of movement of the generated unipolar charges.

* * * * *